US006254518B1

(12) United States Patent
Yu

(10) Patent No.: US 6,254,518 B1
(45) Date of Patent: Jul. 3, 2001

(54) EXERCISE WHEEL

(75) Inventor: Hui-Nan Yu, Tao Yuan (TW)

(73) Assignee: Chen Chang Co., Ltd., Kaohsiung (TW)

( * ) Notice: Subject to any disclaimer, the term of this patent is extended or adjusted under 35 U.S.C. 154(b) by 0 days.

(21) Appl. No.: 09/515,938

(22) Filed: Feb. 29, 2000

(51) Int. Cl.[7] ..... A63B 21/00
(52) U.S. Cl. ..... 482/140; 482/132
(58) Field of Search ..... 482/121, 132, 482/907, 146, 147, 127, 116, 126, 13, 140, 68, 64

(56) References Cited

U.S. PATENT DOCUMENTS 1,824,920 * 9/1931 Novak .
2,920,418 * 1/1960 Britt .
3,403,906 * 10/1968 Burzenski .
3,752,475 * 8/1973 Ott ..... 272/83
3,809,393 * 5/1974 Jones ..... 272/57
6,017,296 * 1/2000 Tang et al. ..... 482/132

* cited by examiner

*Primary Examiner*—Jerome W. Donnelly
*Assistant Examiner*—Lori Baker Amerson
(74) *Attorney, Agent, or Firm*—Browdy& Neimark, PLLC

(57) ABSTRACT

An exercise wheel comprises a housing, a hold bar, a main wheel, an elastic device, an auxiliary wheel set, and a front wheel. The hold bar is put through the housing such that both ends of the hold bar are jutted out of the housing to serve as hand grips. The main wheel is provided with a protrusion and is rotatably mounted on the hold bar. The elastic device is disposed between the main wheel and the housing for providing the main wheel with a recovery spring force. The main wheel is connected with the auxiliary wheel set which is pivoted in the housing such that the auxiliary wheel set in motion is stopped by the protrusion of the main wheel at such time when the auxiliary wheel set is located at a predetermined position. The front wheel comes in contact with a surface on which the exercise wheel rolls.

11 Claims, 7 Drawing Sheets

EXERCISE WHEEL

FIELD OF THE INVENTION

The present invention relates generally to an exercise device, and more particularly to an exercise wheel.

BACKGROUND OF THE INVENTION

As shown in FIG. 1, an exercise wheel of the prior art comprises a hollow shaft 81, which is provided with a slot 82 extending from one end thereof to a midpoint thereof, a volute spring 83 provided with a locating piece 831 which is retained in the slot 82 of the shaft 81, two rollers 84 provided at the center thereof with a round hole 85 dimensioned to fit over both ends of the shaft 81. The two rollers 84 are provided with a hollow guide pillar 86 for fastening a bolt 87. One guide pillar 86' is shorter than the other guide pillar 86 for engaging the locating piece 832 of the volute spring 83. In operation, both hands of an exerciser hold two ends of the shaft 81 to roll the roller on a surface in a reciprocating manner. As the wheel is rolled forward, the volute spring 83 is compressed. When the wheel is rolled backward, the wheel is provided by the compressed volute spring 83 with a recovery spring force. The prior art exercise wheel described above is defective in design in that it has only one wheel by which the exerciser can not keep his or her body in balance with ease, thereby subjecting the exerciser to an injury.

SUMMARY OF THE INVENTION

The primary objective of the present invention is to provide an exercise wheel free from the drawback of the prior art exercise wheel described above.

The exercise wheel of the present invention comprises a housing, a hold bar, a main wheel, an elastic device, an auxiliary wheel, and a front wheel. The hold bar is put through the housing such that both ends of the hold bar are jutted out of the housing to serve as hand grips. The main wheel is provided with a protrusion and is mounted on the hold bar such that the main wheel is located in the housing. The main wheel is forced by an external force to turn on the hold bar. The elastic device is disposed between the main wheel and the housing for providing the main wheel with a recovery force after the main wheel has turned. The rotation of the main wheel is assisted by the auxiliary wheel which is pivoted inside the housing and is connected with the main wheel. The auxiliary wheel in motion is stopped by the protrusion of the main wheel at the time when the auxiliary wheel arrives at a predetermined position. The front wheel makes contact with a surface on which the exercise wheel rolls.

DETAILED DESCRIPTION OF THE INVENTION

Figure 1:
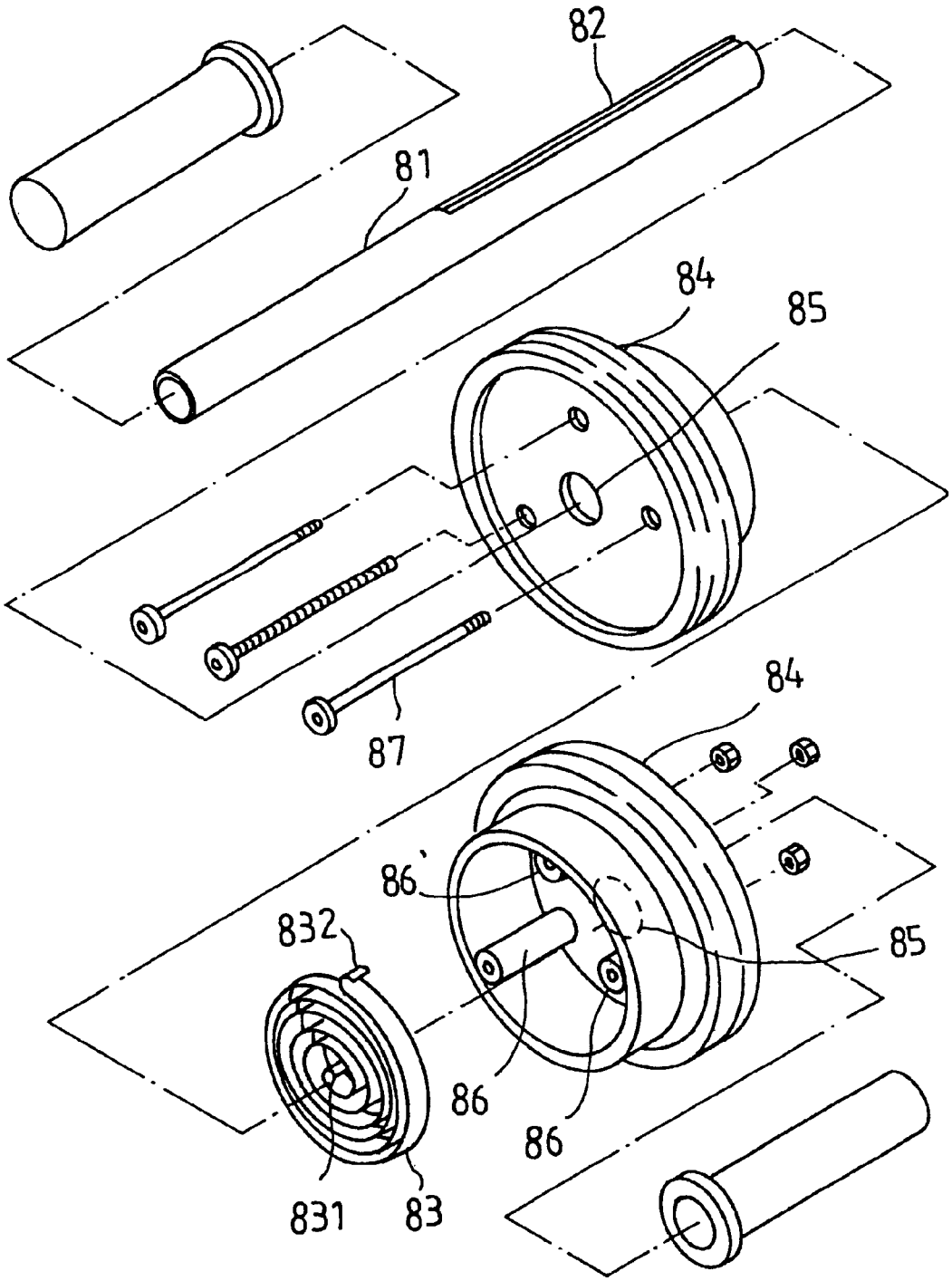
FIG. 1 PRIOR ART
FIG. 1 shows an exploded view of an exercise wheel of the prior art.
Figure 2:
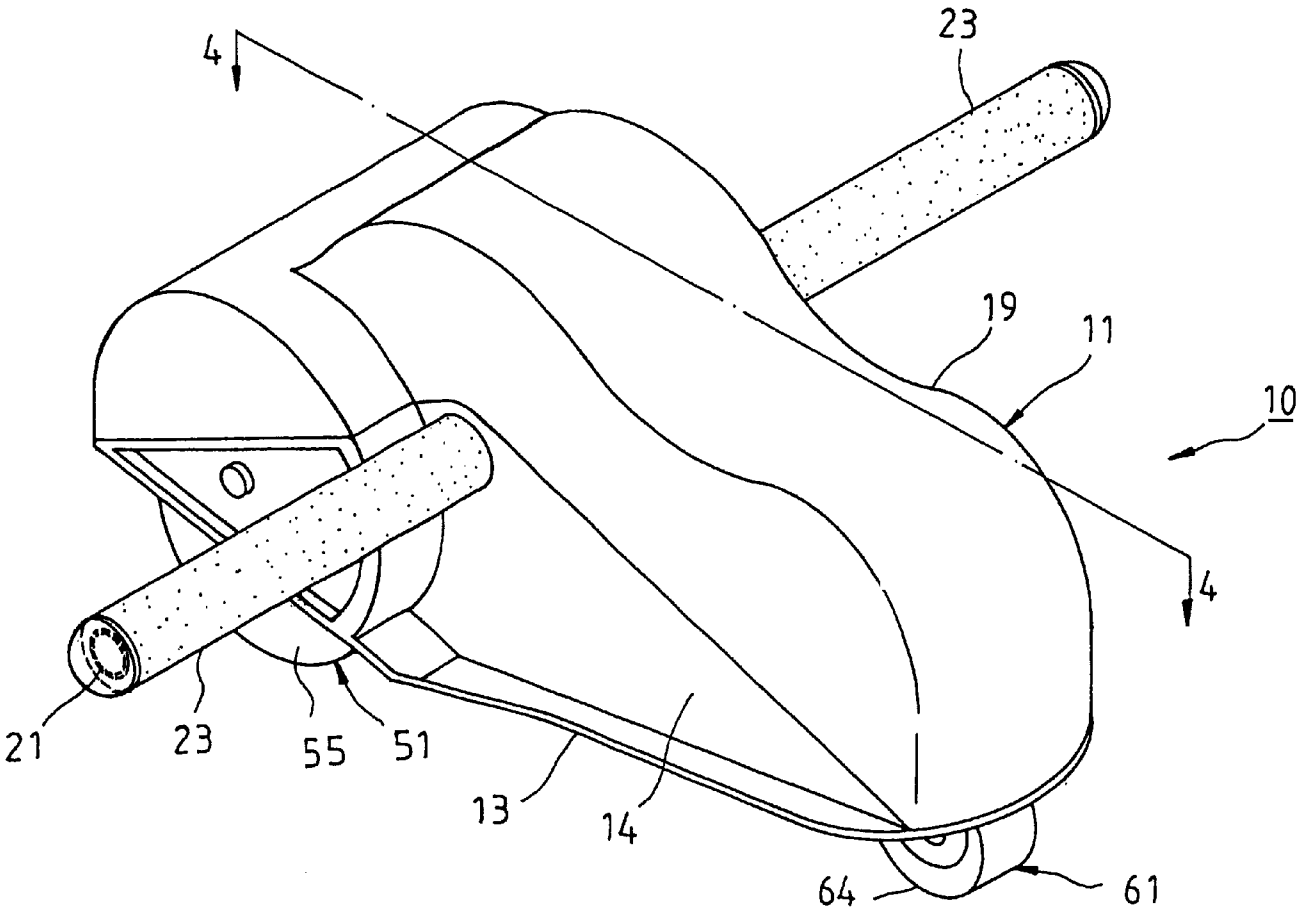
FIG. 2 shows a perspective view of a preferred embodiment of the present invention.
Figure 3:
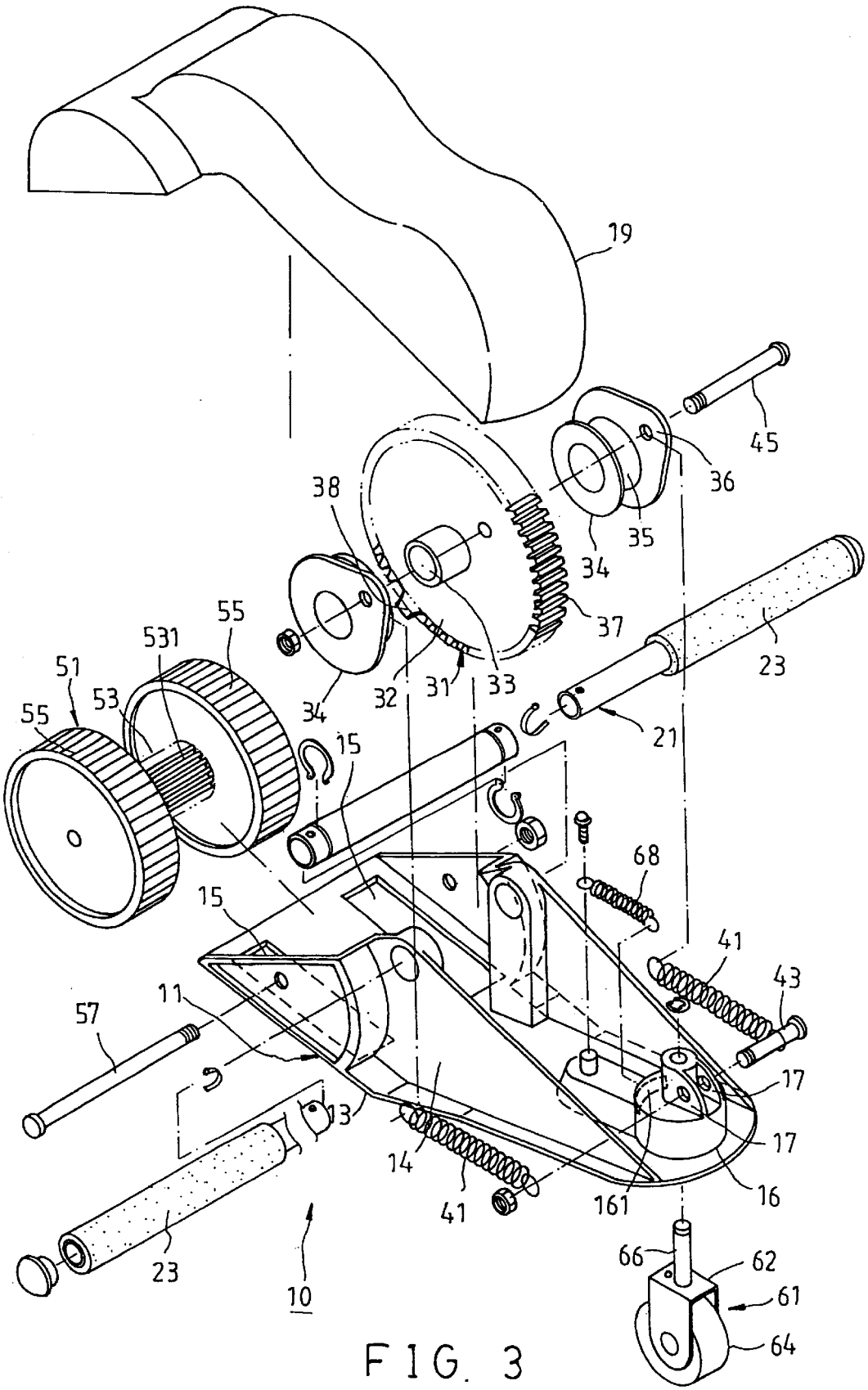
FIG. 3 shows an exploded view of the preferred embodiment of the present invention.
Figure 4:
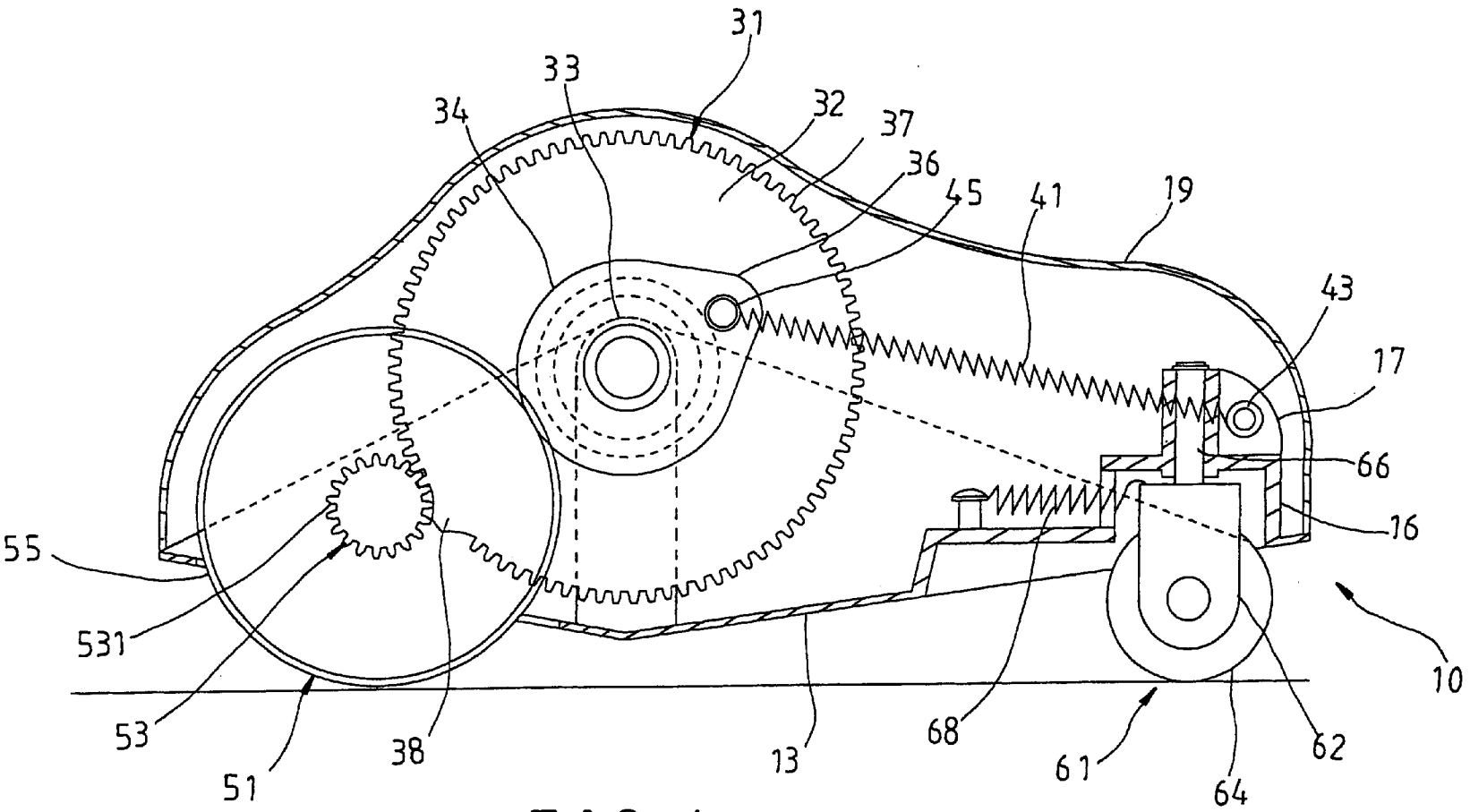
FIG. 4 shows a sectional view of a portion taken along the direction indicated by a line 4—4 as shown in FIG. 2.
Figure 5:
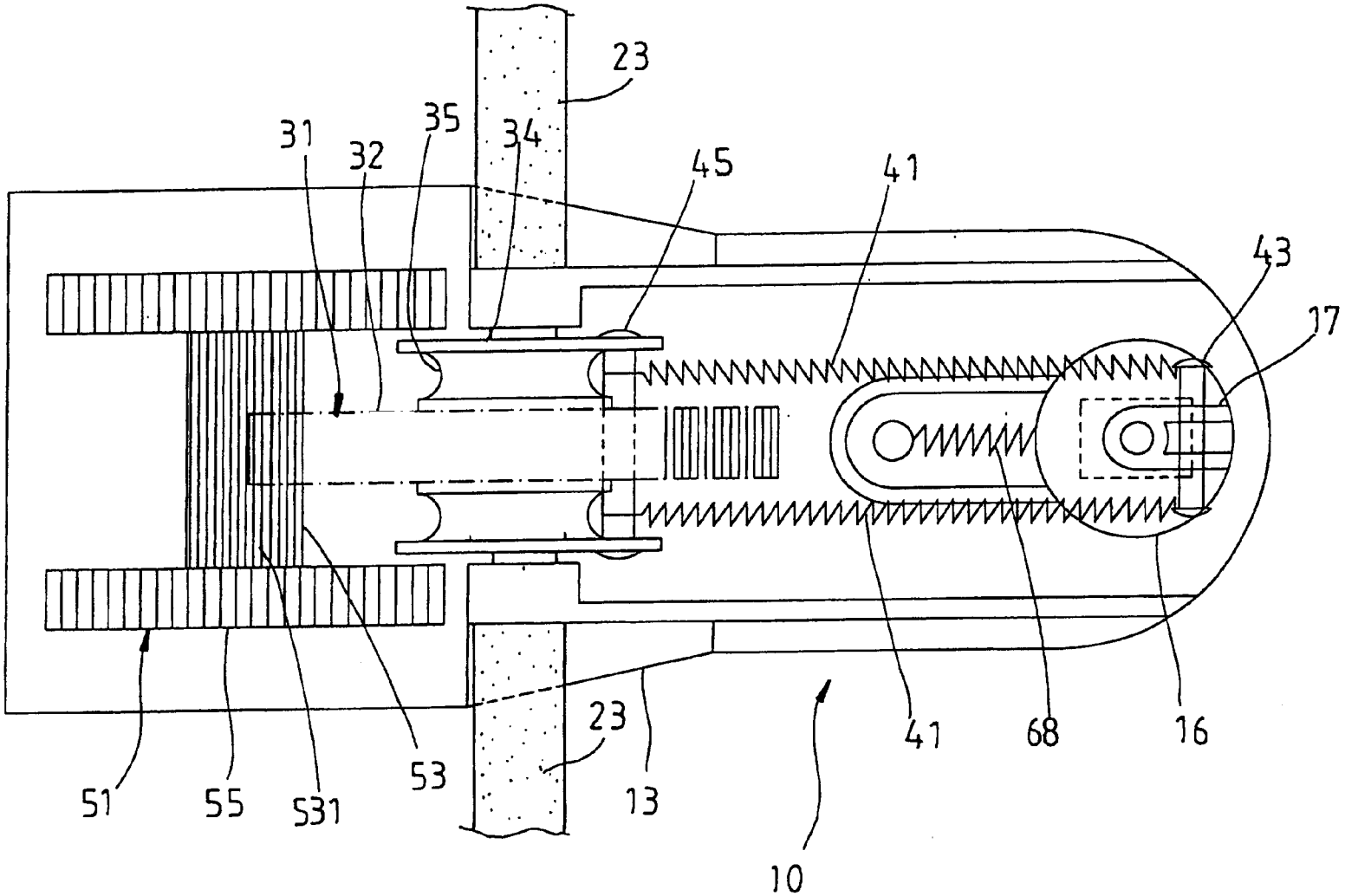
FIG. 5 shows a top sectional plan view of the preferred embodiment of the present invention.
Figure 6:
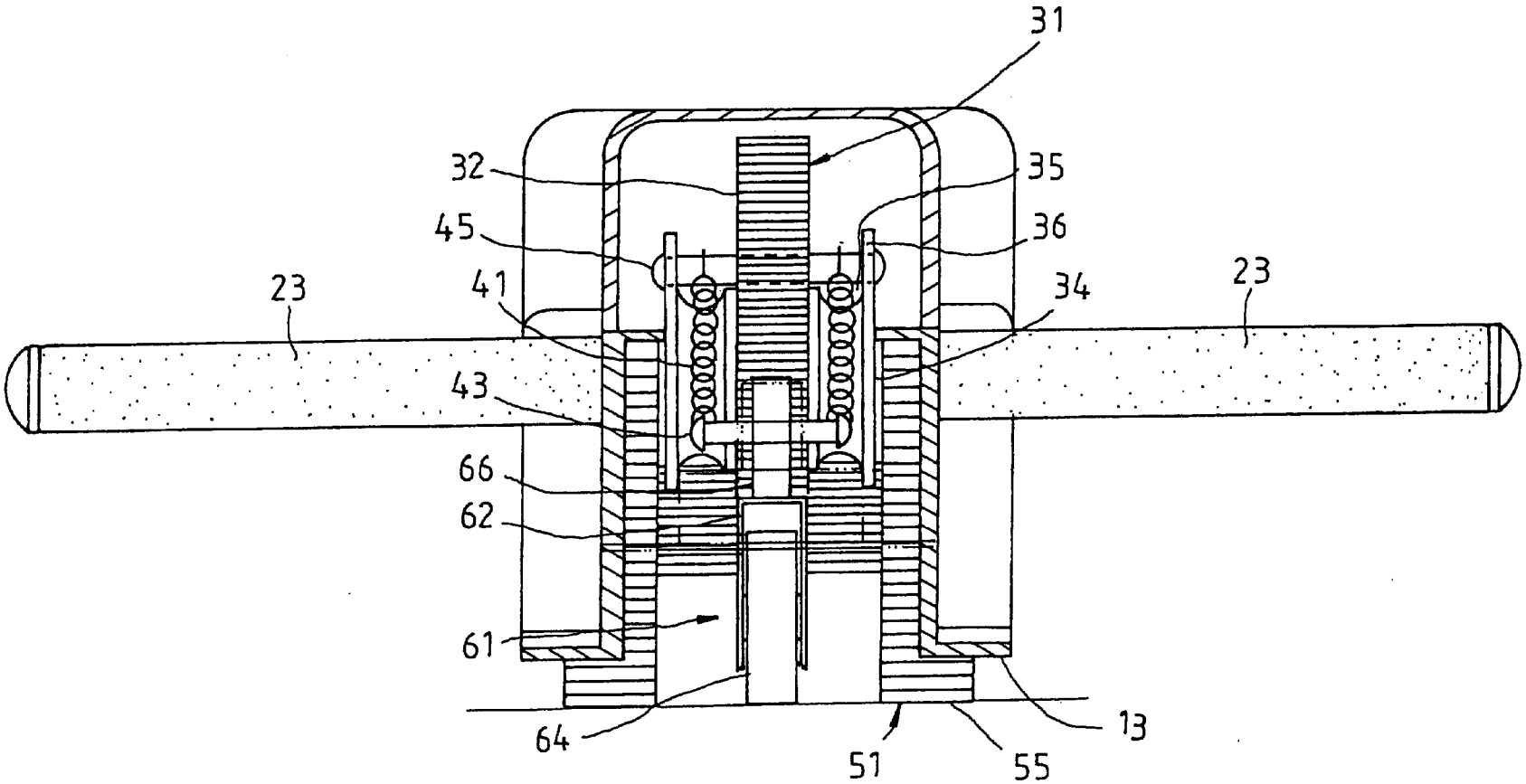
FIG. 6 is a sectional view showing the structural relationship of the main wheel, the auxiliary wheel and the front wheel of the preferred embodiment of the present invention.

As shown in FIGS. 2 and 3, an exercise wheel 10 embodied in the present invention comprises a housing 11, a hold bar 21, a main wheel 31, at least one elastic device 41, an auxiliary wheel set 51, and a front wheel 61.

The housing 11 is formed of a base 13 and an upper cover 19. The base 13 is provided in two sides thereof with an upright wall 14 and is further provided in two sides of the underside thereof with a through hole 15. The base 13 is provided in the front side thereof with a wheel seat 16 which is in turn provided with a through hole 161 and two upright plates 17.

The hold bar 21 is put though the two upright walls 14 of the base 13 such that both ends of the hold bar 21 are exposed. The exposed ends of the hold bar 21 are provided with a grip jacket 23 fitted thereover for providing a gripping comfort.

The main wheel 31 has a body 32 of a disk-shaped construction and is provided in the center thereof with an axial hole 33. The main wheel 31 is mounted on the hold bar 21 by the axial hole 33 and is located between the two upright walls 14 of the base 13. The main wheel 31 can be forced by an external force to turn on the hold bar 21. The main wheel 31 is provided at two ends thereof with a receiving disk 34 which is provided in the fringe thereof with a receiving slot 35 extending along the fringe of the receiving disk 34. The two receiving disks 34 are provided in the fringe thereof with a fastening portion 36, with these two fastening portions 36 being symmetrical to each other. The main wheel 31 is provided in the rim thereof with a plurality of engagement teeth 37 and a protrusion 38.

The exercise wheel 10 of the preferred embodiment of the present invention comprises two elastic devices 41, which are springs. These two springs 41 are fastened at one end thereof with the upright plate 17 by a fastening bolt 43 such that other end thereof is fastened with the fastening portion 36 by a fastening bolt 45.

The auxiliary wheel set 51 is formed of a shaft rod 53, and two rollers 55 which are mounted on the shaft rod 53. The auxiliary wheel set 51 is pivoted on the two upright walls 14 of the base 13 by a bolt 57 such that the two rollers 55 are jutted out of the bottom of the base 13 via the two through holes 15. The shaft rod 53 is provided in the outer surface thereof with an engaging portion 531, which is meshed with the main wheel 31.

The front wheel 61 is composed of a wheel frame 62, a wheel body 64 pivoted with the wheel frame 62, and a top rod 66 pivoted to the top of the wheel frame 62. The top rod 66 is fastened with the wheel seat 16. The wheel frame 62 and the wheel body 64 are turned by an external force exerting thereon. A resilient element 68, which is a spring, is fastened at one end thereof with the base 13 and at other end thereof with the wheel frame of the front wheel 61 via the through hole 161. The direction of the front wheel 61 is corresponding to the axial direction of the housing 11.

As shown in FIG. 3, when the present invention is not in use, the protrusion 38 of the main wheel 31 presses against the shaft rod 53 of the auxiliary wheel set 51. The main wheel 31 can not be acted on by the spring devices 41 to turn.

Figure 7:
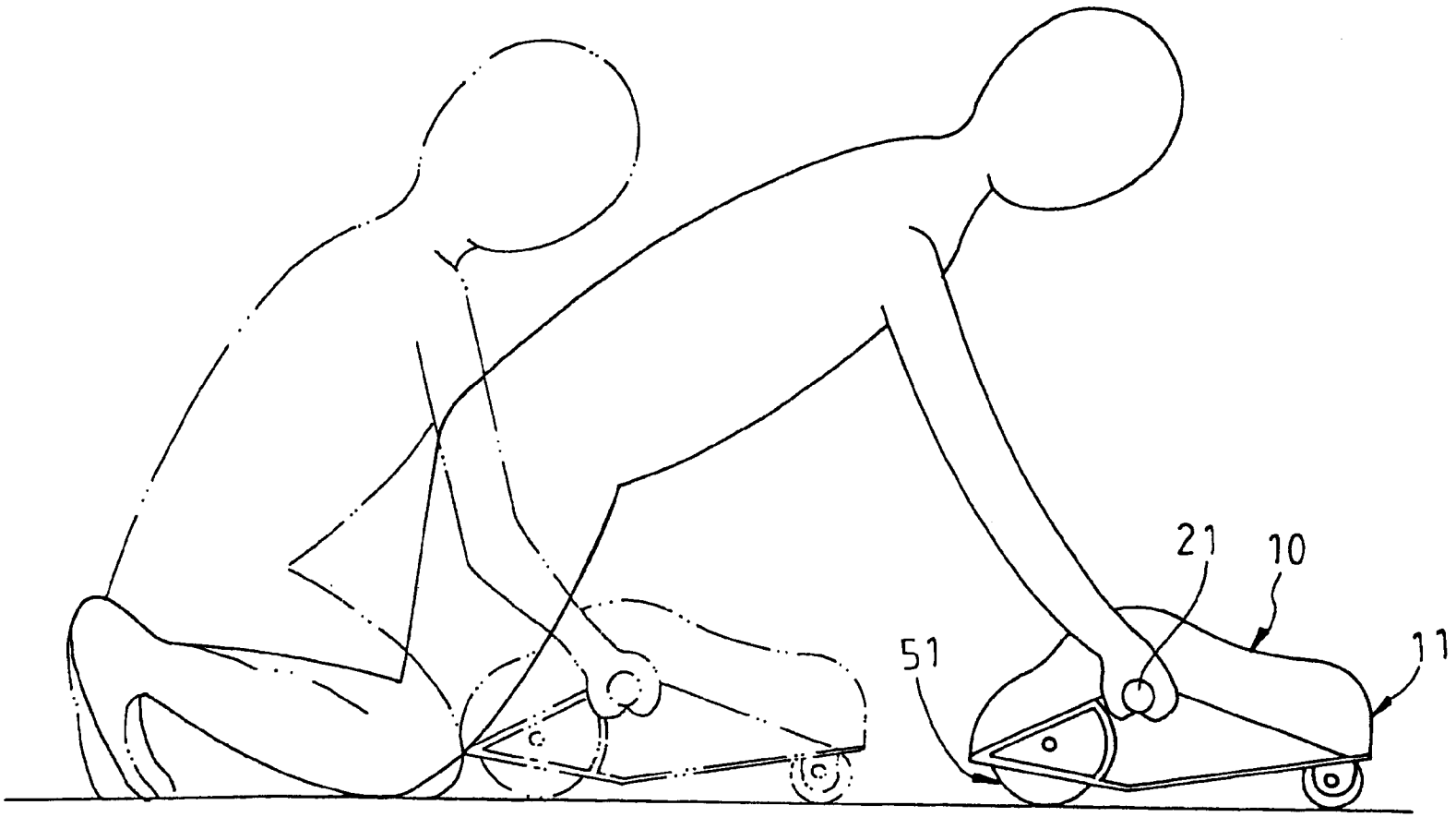
FIG. 7 shows a schematic view of the preferred embodiment of the present invention in action.

Before the exercise wheel 10 of the present invention is used by an exerciser, both hands of the exerciser hold the grip jackets 23 of the hold bar 21. The exerciser then kneels to place the exercise wheel 10 on the surface on which the rollers 55 roll as a starting position, as shown by an imaginary line in FIG. 3. The exercise wheel 10 is pushed forward by the exerciser from the starting point. As the rollers 55 move forward, the main wheel 31 is actuated by the shaft rod 53 to turn rearward along the hold bar 21. The receiving disk 34 and the fastening portion 36 turn rearward to stretch the spring devices 41, which are then received in the receiving slot 35 such that the spring devices 41 wind around the receiving disk 34 to result in a reverse spring force, as shown in FIG. 7. After having pushed forward the exercise wheel 10 for a predetermined distance, the exercise wheel 10 is reversed easily by the exerciser due to the assistance of the reverse spring force. In the process of moving forward and backward, the front wheel of the exercise wheel 10 can be changed in direction by the exerciser. As the wheel body 64 of the front wheel 61 is lifted away from the surface, the front wheel 61 is acted on by the resilient element 68 to return to its starting position. The operation described above is repeated to bring about the effect of the exercise.

After the protrusion 38 of the main wheel 31 has turned almost a full cycle to press against the shaft rod 53 of the auxiliary wheel set 51, the exercise wheel 10 can no longer be moved forward. As a result, the exerciser must pull back the exercise wheel 10 to be ready for another operation.

The engagement of the main wheel 31 with the auxiliary wheel set 51 may be attained by a friction belt (not shown in the drawing) which is arranged in the rim of the main wheel 31 to actuate the main wheel 31 at the time when the auxiliary wheel set 51 is in motion. This is done by arranging the shaft rod 53 to come in contact with the friction belt.

The exercise wheel 10 of the present invention works stably on the surface without tilting and can be used safely by an exerciser.

What is claimed is:

1. An exercise wheel comprising:

a housing formed of a base and an upper cover;

a hold bar penetrating said housing such that both ends of said hold bar are jutted out of said housing to serve as hand grips;

a main wheel provided in a rim thereof with a protrusion and rotatably mounted on said hold bar such that said main wheel is located in said housing;

at least one elastic device disposed between said main wheel and said housing for providing said main wheel with a recovery spring force;

an auxiliary wheel set pivoted in said housing and connected with said main wheel whereby said auxiliary wheel set is jutted out of said base to roll on a surface to actuate said main wheel to turn until such time when said auxiliary wheel set is stopped by said protrusion of said main wheel; and a front wheel fastened pivotally with said base to roll on the surface.

2. The exercise wheel as defined in claim 1, wherein said main wheel is provided at two ends thereof with a receiving disk whereby said receiving disk is provided in a fringe thereof with a receiving slot extending along the fringe, and a fastening portion; and wherein said elastic device is fastened at one end thereof with said fastening portion, and at other end thereof with said base.

3. The exercise wheel as defined in claim 2, wherein said base is provided with a wheel seat; wherein said front wheel is formed of a wheel frame, a wheel body fastened pivotally with said wheel frame, and a top rod pivoted with a top of said wheel frame such that said top rod is fastened with said base and located under side wheel seat to enable said wheel frame and said wheel body to turn in all directions, said wheel seat provided with a through hole, said base being fastened with one end of a resilient element which is fastened at other end thereof with said wheel frame of said front wheel so as to provide said front wheel with a recovery spring force.

4. The exercise wheel as defined in claim 3, wherein said wheel seat of said base is provided with two upright plates; wherein said spring device is fastened at one end thereof with said upright plates, and at other end thereof with said fastening portion of said main wheel.

5. The exercise wheel as defined in claim 3, wherein said resilient element is a spring.

6. The exercise wheel as defined in claim 1, wherein said auxiliary wheel set has a shaft rod and two rollers mounted on said shaft rod, said auxiliary wheel set being pivoted in said housing by a bolt.

7. The exercise wheel as defined in claim 6, wherein said base is provided with two through holes; and wherein said two rollers of said auxiliary wheel set are jutted out of said base via said two through holes of said base.

8. The exercise wheel as defined in claim 6, wherein said base is provided with two upright walls; wherein said hold bar is put through said two upright walls; and wherein said bolt is put through said two upright walls to fasten said auxiliary wheel set in said housing.

9. The exercise wheel as defined in claim 6, wherein said shaft rod of said auxiliary wheel set is engaged with said main wheel.

10. The exercise wheel as defined in claim 9, wherein said shaft rod is provided in an outer surface thereof with an engagement portion; and wherein said main wheel is provided in a rim thereof with a plurality of engagement teeth.

11. The exercise wheel as defined in claim 1, wherein said elastic device is a spring.

* * * * *